US009521937B2

(12) United States Patent
Follows et al.

(10) Patent No.: US 9,521,937 B2
(45) **Date of Patent: *Dec. 20, 2016**

(54) SURFACE TREATING APPLIANCE

(75) Inventors: Thomas James Dunning Follows, Malmesbury (GB); Stephen Benjamin Courtney, Malmesbury (GB); Peter David Gammack, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 643 days.

This patent is subject to a terminal disclaimer.

(21) Appl. No.: 13/509,869

(22) PCT Filed: Nov. 11, 2010

(86) PCT No.: PCT/GB2010/051886

§ 371 (c)(1),
(2), (4) Date: Jul. 20, 2012

(87) PCT Pub. No.: WO2011/058365

PCT Pub. Date: May 19, 2011

(65) Prior Publication Data

US 2012/0272474 A1 Nov. 1, 2012

(30) Foreign Application Priority Data

Nov. 16, 2009 (GB) ..... 0919999.3
Nov. 16, 2009 (GB) ..... 0920000.7

(51) Int. Cl.
*A47L 9/16* (2006.01)

(52) U.S. Cl.
CPC ..... *A47L 9/1641* (2013.01)

(58) Field of Classification Search
CPC .... A47L 9/1683; A47L 9/1666; A47L 7/0028; A47L 7/0038; A47L 7/0042; A47L 9/1641
(Continued)

(56) References Cited

U.S. PATENT DOCUMENTS 2,372,514 A * 3/1945 Pootjes ..... 55/343
3,425,192 A 2/1969 Davis
(Continued)

FOREIGN PATENT DOCUMENTS

CN 1839741 10/2006
EP 0 042 473 12/1981
(Continued)

OTHER PUBLICATIONS

Search Report dated Feb. 19, 2010, directed to GB Patent Application No. 0919999.3; 1 page.
(Continued)

*Primary Examiner* — Robert Scruggs
(74) *Attorney, Agent, or Firm* — Morrison & Foerster LLP

(57) ABSTRACT

A surface treating appliance includes cyclonic separating apparatus having a plurality of cyclones arranged in parallel and a dust collector arranged to receive dust from each of the plurality of cyclones. Each cyclone has a fluid inlet and a fluid outlet. The plurality of cyclones is divided into at least a first set of cyclones and a second set of cyclones. The fluid inlets of the first set of cyclones are located in a first plane and the fluid inlets of the second set of cyclones are located in a second plane spaced from the first plane. This enables the separating apparatus to have a compact appearance.

22 Claims, 16 Drawing Sheets

(58) Field of Classification Search
USPC ..... 15/352, 353, 347; 55/343, 345, 385.3, 55/DIG. 3
See application file for complete search history.

(56) References Cited

U.S. PATENT DOCUMENTS

| | | | | |
|---|---|---|---|---|
| 4,373,228 | A | 2/1983 | Dyson | |
| 6,607,572 | B2 | 8/2003 | Gammack et al. | |
| 8,209,815 | B2 * | 7/2012 | Makarov et al. | 15/352 |
| 8,707,511 | B2 * | 4/2014 | Horne | A47L 9/1633 15/353 |
| 8,707,512 | B2 * | 4/2014 | Horne | A47L 9/1633 15/353 |
| 8,826,492 | B2 * | 9/2014 | Dyson | A47L 9/1633 15/347 |
| 9,044,125 | B2 * | 6/2015 | Follows | A47L 9/1625 |
| 9,282,863 | B2 * | 3/2016 | Follows | A47L 9/009 |
| 2006/0123590 | A1 | 6/2006 | Fester et al. | |
| 2007/0209519 | A1 * | 9/2007 | Conrad | 96/414 |
| 2008/0172994 | A1 * | 7/2008 | Courtney | A47L 9/1625 55/345 |
| 2009/0019821 | A1 * | 1/2009 | Han et al. | 55/345 |

FOREIGN PATENT DOCUMENTS

| | | |
|---|---|---|
| EP | 1 268 076 | 1/2003 |
| EP | 1 721 652 | 11/2006 |
| EP | 1 837 079 | 9/2007 |
| FR | 2.078.957 | 11/1971 |
| GB | 2 426 726 | 12/2006 |
| GB | 2 453 949 | 4/2009 |
| GB | 2490225 | 10/2012 |
| GB | 2492744 | 1/2013 |
| JP | 7-3270 | 1/1995 |
| JP | 2008-541815 | 11/2008 |
| WO | WO-01/74493 | 10/2001 |
| WO | WO-2006/125945 | 11/2006 |

OTHER PUBLICATIONS

Search Report and Written Opinion mailed Feb. 21, 2011, directed to International Patent Application No. PCT/GB2010/051886; 14 pages.

* cited by examiner

SURFACE TREATING APPLIANCE

REFERENCE TO RELATED APPLICATIONS

This application is a national stage application under 35 USC 371 of International Application No. PCT/GB2010/051886, filed Nov. 11, 2010, which claims the priority of United Kingdom Application No. 0919999.3, filed Nov. 16, 2009, and United Kingdom Application No. 0920000.7, filed Nov. 16, 2009, the entire contents of which are incorporated herein by reference.

FIELD OF THE INVENTION

The present invention relates to a surface treating appliance. In its preferred embodiment, the appliance is in the form of an upright vacuum cleaner.

BACKGROUND OF THE INVENTION

Vacuum cleaners which utilise cyclonic separating apparatus are well known. Examples of such vacuum cleaners are shown in EP 0042473, U.S. Pat. No. 4,373,228, 3,425,192, 6,607,572 and EP 1268076. The separating apparatus comprises first and second cyclonic separating units through which an incoming air passes sequentially. This allows the larger dirt and debris to be extracted from the airflow in the first separating unit, enabling the second cyclone to operate under optimum conditions and so effectively to remove very fine particles in an efficient manner.

In some cases, the second cyclonic separating unit includes a plurality of cyclones arranged in parallel. These cyclones are usually arranged in a ring extending about the longitudinal axis of the separating apparatus. Through providing a plurality of relatively small cyclones in parallel instead of a single, relatively large cyclone, the separation efficiency of the separating unit, that is, the ability of the separating unit to separate entrained particles from an air flow, can be increased. This is due to an increase in the centrifugal forces generated within the cyclones which cause dust particles to be thrown from the air flow.

Increasing the number of parallel cyclones can further increase the separation efficiency, or pressure efficiency, of the separating unit for the same overall pressure resistance. However, when the cyclones are arranged in a ring this can increase the external diameter of the separating unit, which in turn can undesirably increase the size of the separating apparatus. While this size increase can be ameliorated through reducing the size of the individual cyclones, the extent to which the cyclones can be reduced in size is limited. Very small cyclones can become rapidly blocked and can be detrimental to the rate of the air flow through the vacuum cleaner, and thus its cleaning efficiency.

SUMMARY OF THE INVENTION

In a first aspect the present invention provides a surface treating appliance comprising a first cyclonic separating unit and, downstream from the first cyclonic separating unit, a second cyclonic separating unit comprising a plurality of cyclones arranged in parallel about an axis and a dust collector arranged to receive dust from each of the plurality of cyclones, each cyclone comprising a fluid inlet and a fluid outlet, the plurality of cyclones being divided into at least a first set of cyclones and a second set of cyclones, the fluid inlets of the first set of cyclones being arranged in a first group and the fluid inlets of the second set of cyclones being arranged in a second group spaced along said axis from the first group.

Separating the cyclones of the second cyclonic separating unit into first and second sets which are each arranged about a common axis and have fluid inlets grouped together can allow the sets of cyclones to be spaced along the axis. This can enable both the number and the size of cyclones of the second cyclonic separating unit to be chosen for optimized separation efficiency and cleaning efficiency within the dimensional constraints for the separating apparatus. For example, if the optimum number of cyclones for the second cyclonic separating unit is twenty four then these cyclones may be arranged in two sets of twelve cyclones, three sets of eight cyclones or four sets of six cyclones depending on the maximum diameter for the separating apparatus and/or the maximum height for the separating apparatus. The provision of a common dust collector for each of the sets of cyclones can facilitate emptying and cleaning of the second cyclonic separating unit.

The fluid inlets of the sets of cyclones may be arranged in one of a number of different arrangements. For example, the inlets may be arranged in helical arrangements extending about the axis. Preferably, the first group of fluid inlets is generally arranged in a first annular arrangement, and the second group of fluid inlets is generally arranged in a second annular arrangement spaced along said axis from the first annular arrangement. Each of these annular arrangements is preferably substantially orthogonal to the axis. The annular arrangements are preferably of substantially the same size. Within each annular arrangement, the fluid inlets are preferably located substantially within a common plane.

Alternatively, the fluid inlets may be located in a number of different planes which are each preferably substantially orthogonal to said axis.

The axis is preferably a longitudinal axis of the first cyclonic separating unit. The first cyclonic separating unit preferably comprises a single cyclone, which is preferably substantially cylindrical. The first cyclonic separating unit preferably at least partially surrounds the dust collector. The appliance preferably comprises a second dust collector arranged to receive dust from the first cyclonic separating unit. This second dust collector is preferably arranged to be emptied simultaneously with the dust collector for receiving dust from each of the cyclones of the second cyclonic separating unit. The second dust collector is preferably annular in shape.

The first set of cyclones is preferably arranged around part of the second set of cyclones. Each of the cyclones of the second cyclonic separating unit preferably has a tapering body, which is preferably frusto-conical in shape. Within each set, the cyclones are preferably substantially equidistant from said axis. Alternatively, or additionally, the cyclones may be substantially equidistantly, or equi-angularly, spaced about said axis. The first set of cyclones is preferably arranged so that the longitudinal axes of the cyclones approach one another. Similarly, the second set of cyclones is preferably arranged so that longitudinal axes of the cyclones approach one another. In either case, the longitudinal axes of the cyclones preferably intersect the longitudinal axis of the first cyclonic separating unit.

The angle at which the longitudinal axes of the first set of the cyclones intersect the longitudinal axis of the first cyclonic separating unit may be substantially the same as the angle at which the longitudinal axes of the second set of the cyclones intersect the longitudinal axis of the first cyclonic separating unit. Alternatively, the angle at which the longitudinal axes of the first set of the cyclones intersect the longitudinal axis of the first cyclonic separating unit may be different from the angle at which the longitudinal axes of the second set of the cyclones intersect the longitudinal axis of the first cyclonic separating unit. For example, the angle at which the longitudinal axes of the second set of the cyclones intersect the longitudinal axis of the first cyclonic separating unit may be greater than the angle at which the longitudinal axes of the first set of the cyclones intersect the longitudinal axis of the first cyclonic separating unit. Increasing the angle at which one of the sets of cyclones is inclined to the longitudinal axis of the first cyclonic separating unit can decrease the overall height of the separating apparatus.

The appliance may comprise a manifold for receiving the fluid from the first cyclonic separating unit, and for conveying the fluid to the second cyclonic separating unit. In this case, each of the fluid inlets of the cyclones of the first and second sets of cyclones is arranged to receive fluid from the manifold. Alternatively, the appliance may comprise a plurality of conduits for conveying fluid from the first cyclonic separating unit to the second cyclonic separating unit. The fluid inlet of each cyclone may be connected to a respective conduit. However, to reduce the number of conduits the cyclones are preferably arranged within each set in a plurality of subsets, with each subset comprising at least two cyclones and with the fluid inlets of each subset of cyclones being arranged to receive fluid from a respective conduit. Therefore, in a second aspect the present invention provides a surface treating appliance comprising a first cyclonic separating unit, a second cyclonic separating unit comprising a plurality of cyclones arranged in parallel, each cyclone comprising a fluid inlet and a fluid outlet, the plurality of cyclones being divided into at least a first set of cyclones and a second set of cyclones, and a plurality of conduits for conveying fluid from the first cyclonic separating unit to the second cyclonic separating unit, wherein within each set the cyclones are arranged in a plurality of subsets, each subset comprising at least two cyclones, the fluid inlets of each subset of cyclones being arranged to receive fluid from a respective conduit.

The appliance preferably comprises a shroud forming an outlet from the first cyclonic separating unit, the shroud comprising a wall having a multiplicity of through-holes, and wherein each conduit comprises an inlet located behind the wall of the shroud.

Each conduit may be arranged to convey fluid to a single subset of cyclones. In other words, the plurality of conduits may be divided into a first set of conduits which each convey fluid from the first cyclonic separating unit to a respective subset of cyclones of the first set of cyclones, and a second set of conduits which each convey fluid from the second cyclonic separating unit to a respective subset of cyclones of the second set of cyclones. Each of the first set of conduits may be located between two adjacent conduits of the second set of conduits.

Alternatively, each conduit may be arranged to convey fluid to a respective subset of cyclones of each set of cyclones. This arrangement may be preferred when the second cyclonic separating unit comprises three or more sets of cyclones, as it can enable the number of conduits to be minimized.

The appliance preferably comprises a plurality of outlet conduits for conveying fluid from the second cyclonic separating unit to an outlet chamber. Each outlet conduit may be arranged to convey fluid from a respective cyclone to the outlet chamber. Alternatively, each outlet conduit may be arranged to convey fluid from at least one of a subset of cyclones of the first set of cyclones and a subset of cyclones of the second set of cyclones to the outlet chamber. The outlet chamber is preferably arranged to convey fluid to an outlet duct. Each set of cyclones preferably extends about the outlet duct.

The first set of cyclones and the second set of cyclones preferably comprise the same number of cyclones. Each of the first set of cyclones and the second set of cyclones may comprise at least six cyclones.

The second set of cyclones is preferably located above at least part of the first set of cyclones, which is in turn preferably located above at least part of the first cyclonic separating unit. Each cyclone of the second set of cyclones may be located immediately above a respective cyclone of the first set of cyclones. However, to reduce the height of the separating apparatus the second set of cyclones may be angularly offset about the longitudinal axis of the first cyclonic separating unit relative to the first set of cyclones. For example, each cyclone of the second set of cyclones may be located angularly between, and spaced along the axis from, an adjacent pair of cyclones of the first set of cyclones. This can allow the first and second sets of cyclones to be brought closer together, reducing the overall height of the separating apparatus.

The first cyclonic separating unit and the second cyclonic separating unit preferably form part of a separating apparatus removably mounted on a main body of the appliance. The outlet duct preferably has an outlet located in the base of the separating apparatus.

The surface treating appliance is preferably in the form of a vacuum cleaning appliance. The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

Features described above in connection with the first aspect of the invention are equally applicable to the second aspect, and vice versa.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
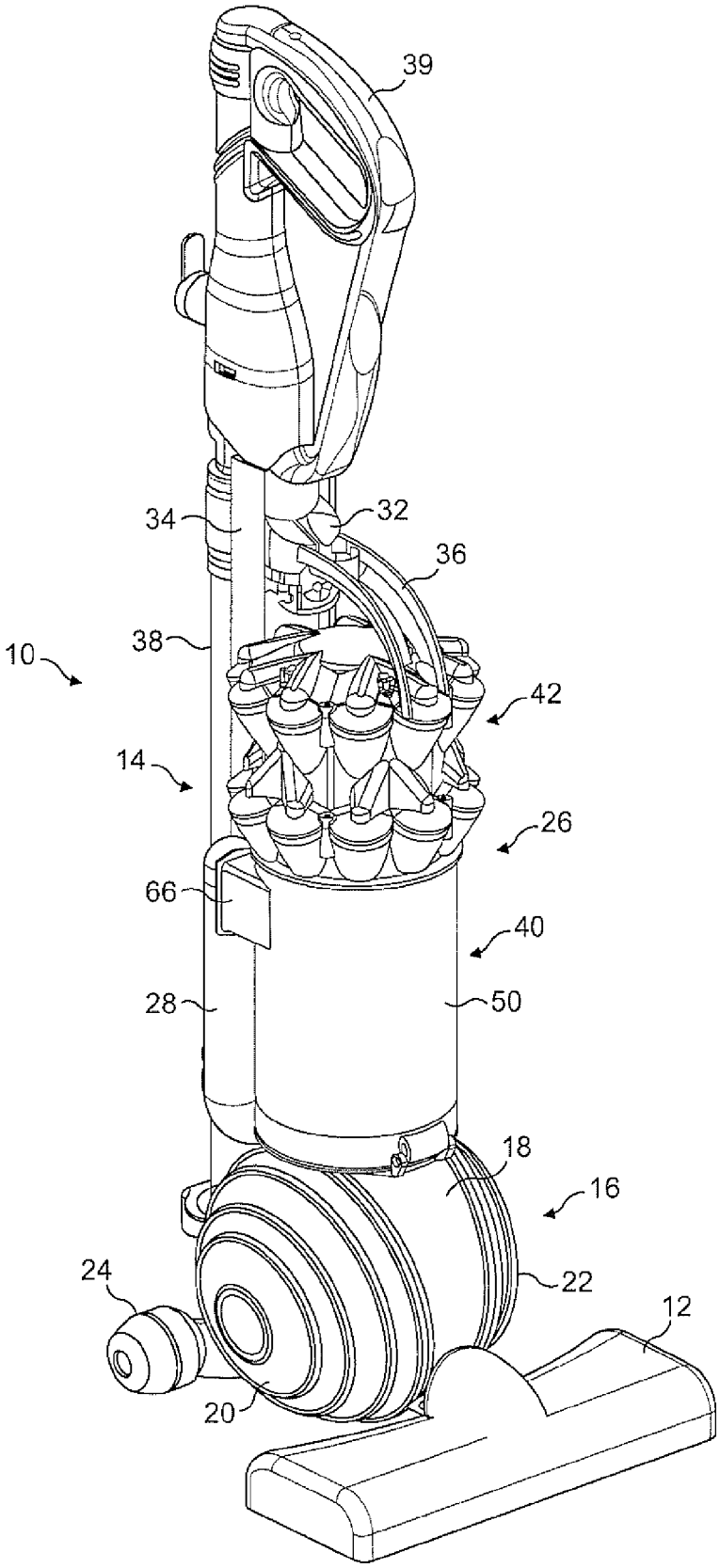
FIG. 1 is a front perspective view, from above, of a first example of an upright vacuum cleaner.

FIG. 1 illustrates a first example of a surface treating appliance, which is in the form of an upright vacuum cleaner. The vacuum cleaner 10 comprises a cleaner head 12, a main body 14 and a support assembly 16 for allowing the vacuum cleaner 10 to be rolled along a floor surface. The cleaner head 12 comprises a dirty air inlet located on the underside of the cleaner head 12 facing the surface to be treated. The cleaner head 12 is pivotably connected to a yoke 18 of the support assembly 16, which is in turn pivotably connected to the lower end of the main body 14. The support assembly 16 comprises a pair of wheels 20, 22 rotatably connected to the yoke 18. Each wheel 20, 22 is dome-shaped, and has an outer surface of substantially spherical curvature so that the yoke 18 and the wheels 20 combine to form an arcuate surface. A motor and fan unit (not shown) of the main body 14 is located between the wheels 20, 22 of the support assembly 16 for drawing an air flow through the vacuum cleaner 10. One of the wheels 20, 22 comprises a plurality of air outlets (not shown) for exhausting the air flow from the vacuum cleaner 10. The support assembly 16 further comprises a stand 24 which is movable relative to the main body 14 between a supporting position, as illustrated in FIG. 1, for supporting the main body 14 in an upright position and a retracted position for allowing the vacuum cleaner 10 to be maneuvered over a floor surface.

The main body 14 includes separating apparatus 26 for removing dirt, dust and/or other debris from a dirt-bearing airflow which is drawn into the vacuum cleaner 10 by the motor and fan unit. A first ducting arrangement 28 provides communication between the dirty air inlet of the cleaner head 12 and the separating apparatus 26, whereas a second ducting arrangement (not shown) protruding from the top of the support assembly 16 provides communication between the separating apparatus 26 and the motor and fan unit. A first part of the first ducting arrangement 28 passes through the support assembly 16, and a second part of the first ducting arrangement 28 passes along the side of the separating apparatus 26 to convey the air flow into the separating apparatus 26. The base 30 of the separating apparatus 26 is mounted on an inlet section (not shown) of the second ducting arrangement, and a manually-operable catch 32 releasably retains the separating apparatus 26 on the spine 34 of the main body 14. The separating apparatus 26 may include a handle 36 to facilitate the removal of the separating apparatus 26 from the main body 14. The main body 14 also includes a hose and wand assembly 38 which is releasably connected to the spine 34 of the main body 14, and a handle 39.

In use, the motor and fan unit draws dust laden air into the vacuum cleaner 10 via either the dirty air inlet of the cleaner head 12 or the hose and wand assembly 38. The dust laden air is carried to the separating apparatus 26 via the first ducting arrangement 28. Dirt and dust particles entrained within the air flow are separated from the air and retained in the separating apparatus 26. The cleaned air is conveyed by the second ducting arrangement to the motor and fan unit located within the support assembly 16, and is subsequently expelled through the air outlets 24.

In overview, the separating apparatus 26 comprises a first cyclonic separating unit 40 and a second cyclonic separating unit 42 located downstream from the first cyclonic separating unit 40. The second cyclonic separating unit 42 is disposed above the first cyclonic separating unit 40, and in this example the first cyclonic separating unit 40 extends about part of the second cyclonic separating unit 42.

The separating apparatus 26 is shown in more detail in FIGS. 2 to 6; the handle 36 has been omitted from these figures to show more clearly the arrangement of the second cyclonic separating unit 42. The specific overall shape of the separating apparatus 26 can be varied according to the type of vacuum cleaner 10 in which the separating apparatus 26 is to be used. For example, the overall length of the separating apparatus 26 can be increased or decreased with respect to the diameter of the separating apparatus 26.

Figure 2:
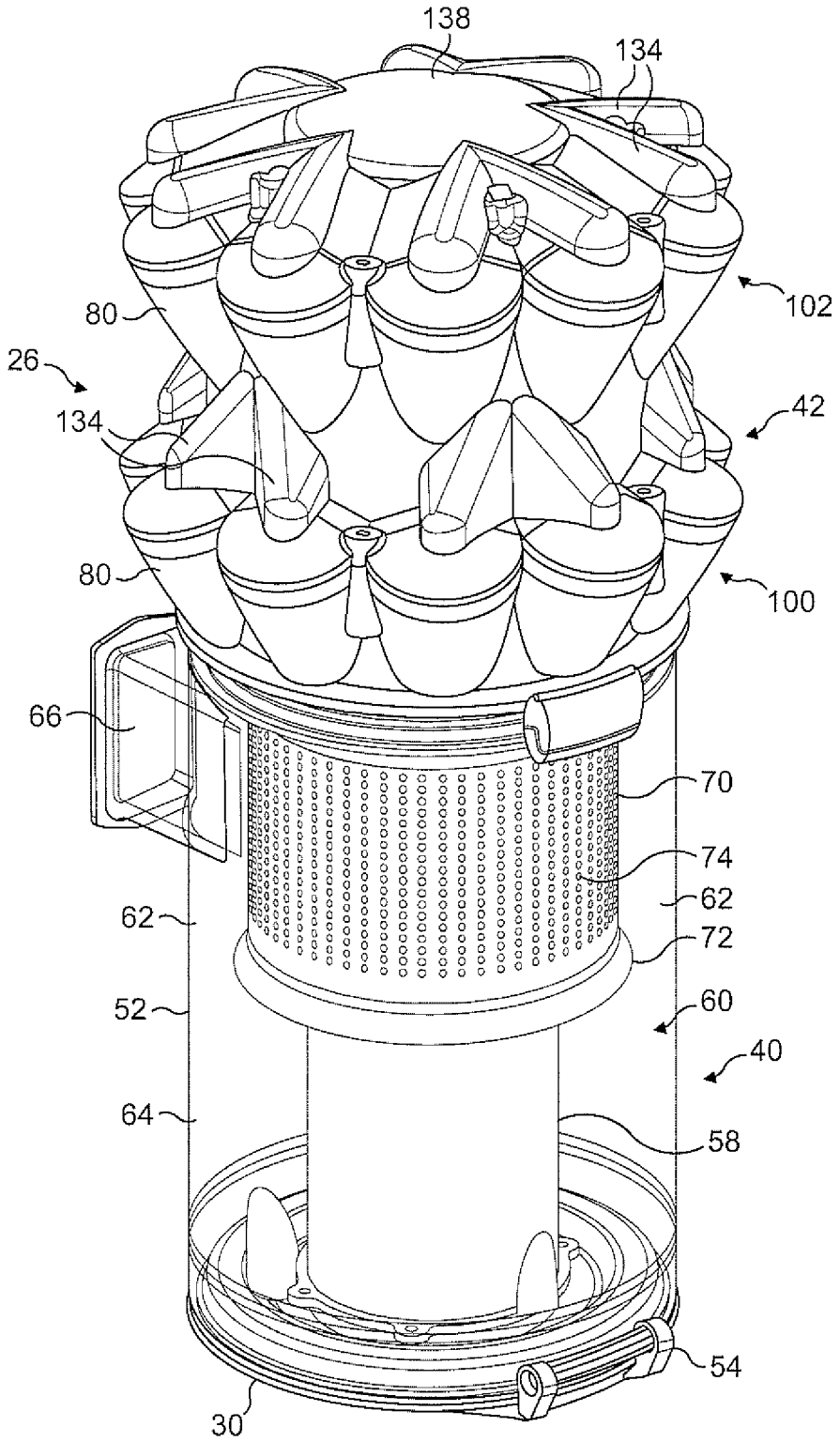
FIG. 2 is a front perspective view, from above of a separating apparatus of the cleaner of FIG. 1.
Figure 3:
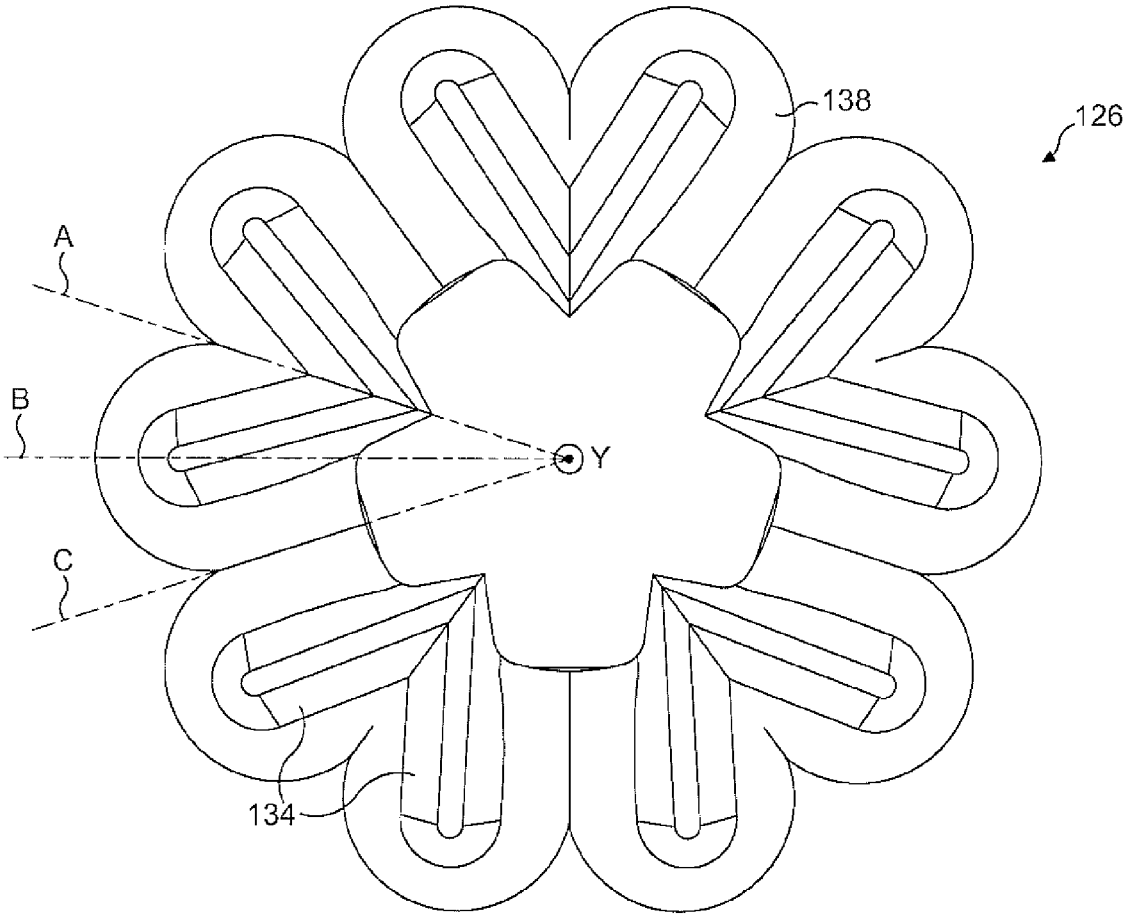
FIG. 3 is a top view of the separating apparatus.

The separating apparatus 26 comprises an outer bin 50 which has an outer wall 52 which is substantially cylindrical in shape, and which extends about a longitudinal axis Y. The outer bin 50 is preferably transparent, and the components of the separating apparatus 26 which are visible through the outer bin 50 are shown in FIG. 2. The lower end of the outer bin 50 is closed by the base 30 of the separating apparatus. The base 30 is pivotably attached to the outer wall 52 by means of a pivot 54 and held in a closed position by a catch (not shown). The separating apparatus 26 further comprises a second cylindrical wall 58 which is co-axial with the outer wall 52. The second cylindrical wall 58 engages and is sealed against the base 30 when the base 30 is in the closed position. The second cylindrical wall 58 is located radially inwardly of the outer wall 52 and spaced therefrom so as to form an annular chamber 60 therebetween. In this example the upper portion of the annular chamber 60 forms a cylindrical cyclone 62 of the first cyclonic separating unit 40 and the lower portion of the annular chamber 60 forms a dust collecting bin 64 of the first cyclonic separating unit 40.

A dirty air inlet 66 is provided at the upper end of the outer bin 50 for receiving an air flow from the first ducting arrangement 28. The dirty air inlet 66 is arranged tangentially to the outer bin 50 so as to ensure that incoming dirty air is forced to follow a helical path around the annular chamber 60.

A fluid outlet is provided in the outer bin 50 in the form of a shroud. The shroud has an upper wall 68 formed in a frusto-conical shape, a lower cylindrical wall 70 and a skirt 72 depending from the cylindrical wall 70. The skirt 72 tapers outwardly from the lower cylindrical wall 70 in a direction towards the outer wall 52. A large number of perforations 74 are formed in the lower cylindrical wall 70 of the shroud, and which provide the only fluid outlet from the outer bin 50.

Figure 4:
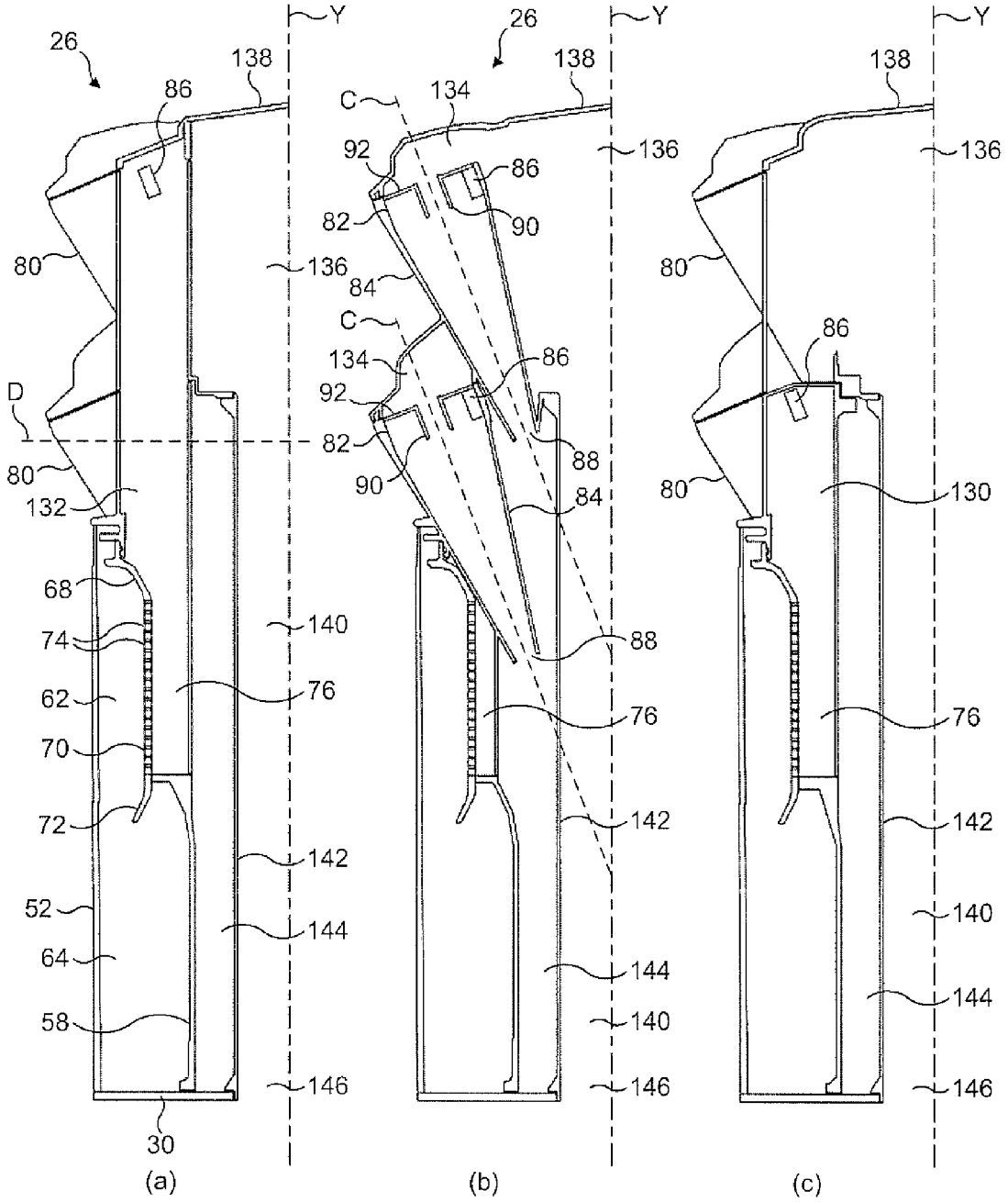
FIG. 4(*a*) is a vertical section through the separating apparatus along line A in FIG. 3, FIG. 4(*b*) is vertical section through the separating apparatus along line B in FIG. 3, and FIG. 4(*c*) is vertical section through the separating apparatus along line C in FIG. 3.

A second annular chamber 76 is located behind the shroud. A plurality of conduits communicate with the chamber 76 for conveying air from the first cyclonic separating unit 40 to the second cyclonic separating unit 42. The second cyclonic separating unit 42 comprises a plurality of cyclones 80 arranged in parallel to receive air from the first cyclonic separating unit 40. With reference to FIGS. 4(*a*) to 4(*c*), in this example the cyclones 80 are substantially identical and each cyclone 80 comprises a cylindrical portion 82 and a tapering portion 84 depending therefrom. The cylindrical portion 82 comprises an air inlet 86 for receiving fluid from one of the conduits. The tapering portion 84 of each cyclone 80 is frusto-conical in shape and terminates in a cone opening 88. A vortex finder 90 is provided at the upper end of each cyclone 80 to allow air to exit the cyclone 80. Each vortex finder 90 extends downwardly from a vortex finder plate 92 which is disposed over the cylindrical portion 82.

Figure 5:
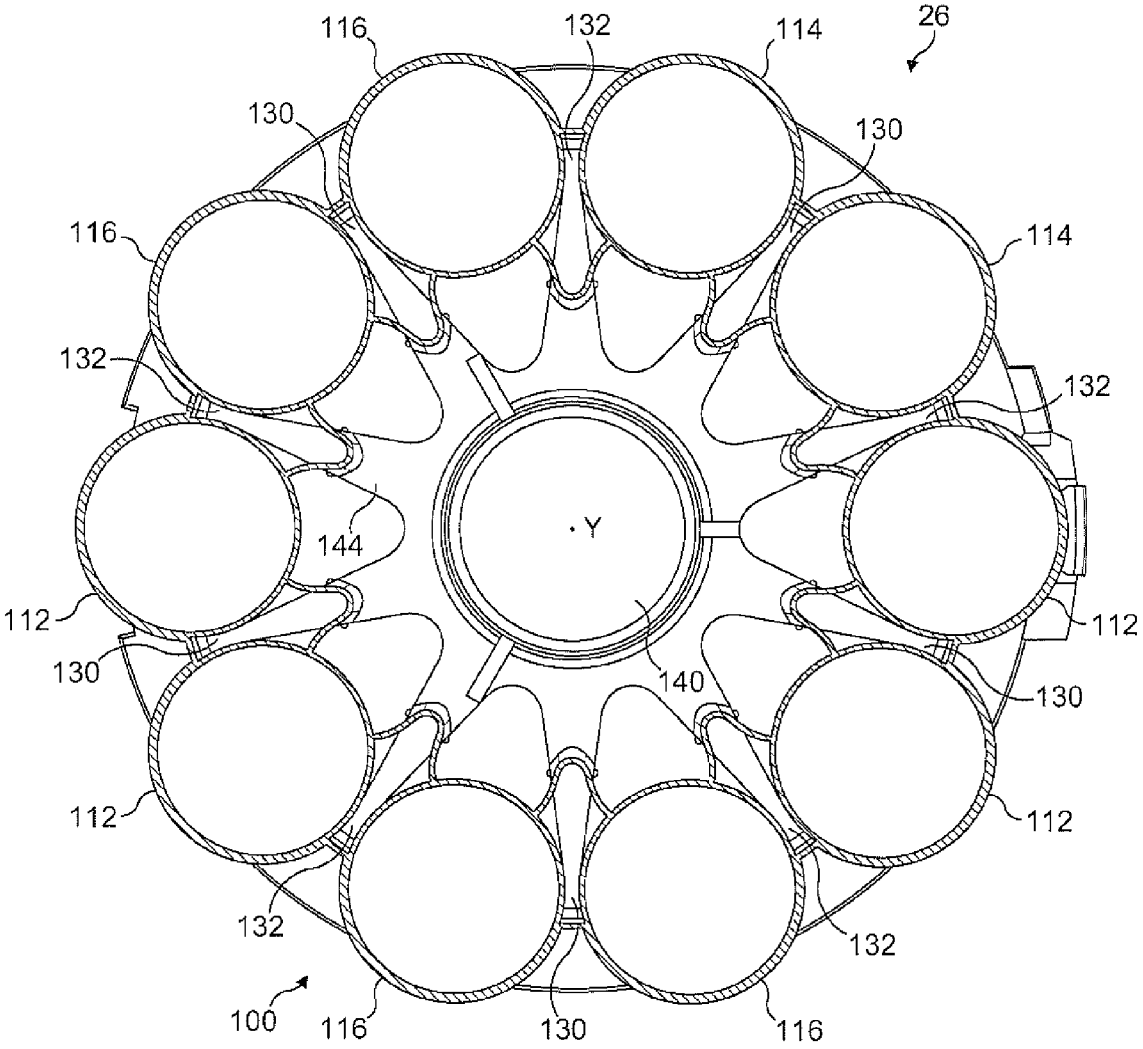
FIG. 5 is a top sectional view of the separating apparatus along line D in FIG. 4(*a*)
Figure 6:
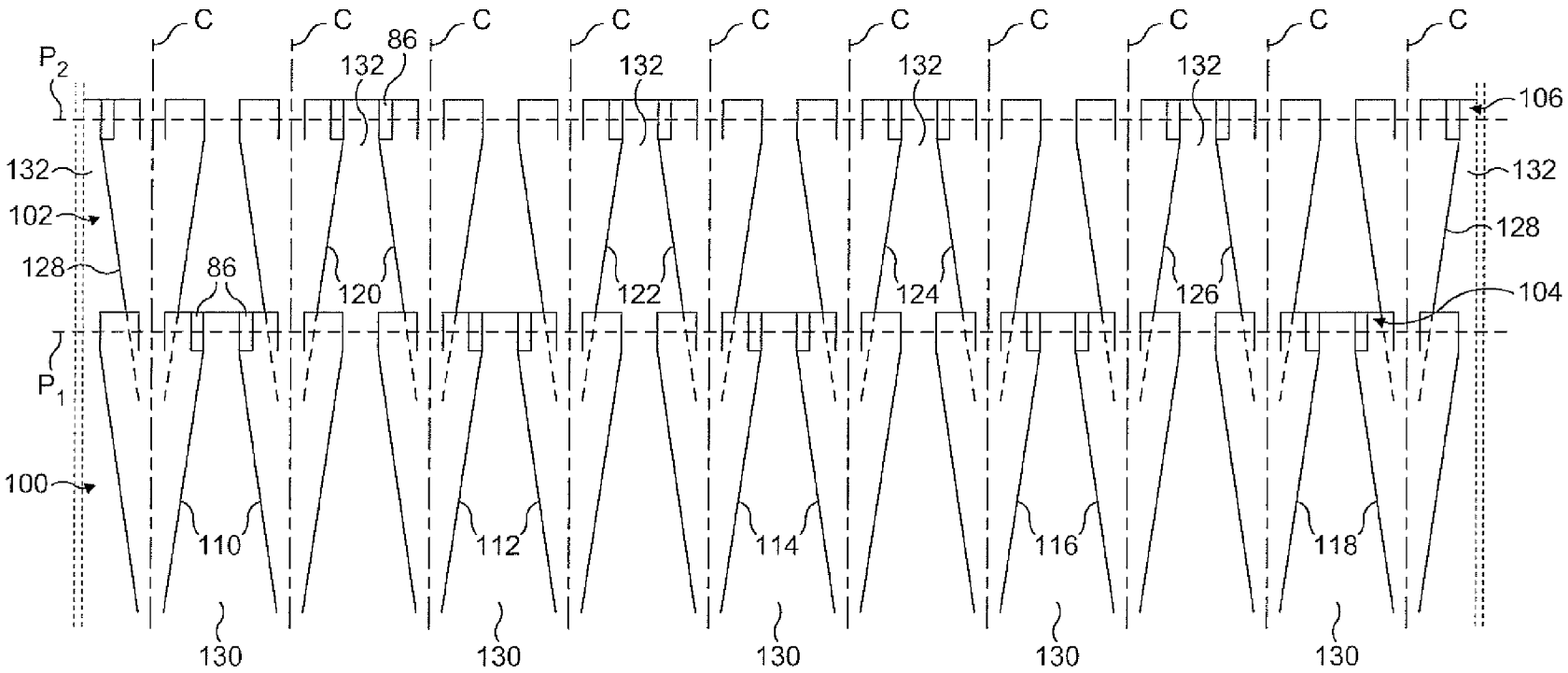
FIG. 6 is a schematic illustration of the arrangement of the cyclones of the second cyclonic separating unit about the central axis of the separating apparatus.

With reference also to FIGS. 5 and 6, in this example the cyclones of the second cyclonic separating unit 42 are divided into a first set of cyclones 100 and a second set of cyclones 102. Each set of cyclones 100, 102 preferably comprises the same number of cyclones 80, and in this example each set of cyclones 100, 102 comprises ten cyclones 80. Each set of cyclones 100, 102 is arranged in a ring which is centered on a longitudinal axis Y of the outer wall 52. Within each set of cyclones 100, 102 each cyclone 80 has a longitudinal axis C which is inclined downwardly and towards the longitudinal axis Y of the outer wall 52. The longitudinal axes C are all inclined at the same angle to the longitudinal axis Y of the outer wall 52. Within each set of cyclones 100, 102, the cyclones 80 are substantially equidistant from the longitudinal axis Y, and are substantially equidistantly spaced about the longitudinal axis Y.

To reduce the external diameter of the separating apparatus 26, the arrangement of the sets of cyclones 100, 102 is such that the air inlets 86 of the first set of cyclones 100 are arranged in a first group 104, and the air inlets 86 of the second set of cyclones 102 are arranged in a second group 106 which is spaced along the longitudinal axis Y from the first group 104. In this example each group 104, 106 of air inlets 86 is located within a respective plane $P_1$, $P_2$, with each of these planes $P_1$, $P_2$ being substantially orthogonal to the longitudinal axis Y. The planes $P_1$, $P_2$ are located along the longitudinal axis Y so that the second set of cyclones 102 is located above the first set of cyclones 100. To minimise the increase in the height of the separating apparatus 26, the first cyclonic separating unit 40 extends about a lower part of the first set of cyclones 100 and the first set of cyclones 100 extends about a lower part of the second set of cyclones 102.

Within each set of cyclones 100, 102, the cyclones 80 are further divided into a plurality of subsets which each comprise at least two cyclones 80. In this example, each subset of cyclones 80 comprises an adjacent pair of cyclones 80 so that the first set of cyclones 100 is divided into five subsets of cyclones 110, 112, 114, 116, 118, and the second set of cyclones 102 is also divided into five subsets of cyclones 120, 122, 124, 126, 128. Within each subset, the cyclones 80 are arranged so that the air inlets 86 are located opposite to each other.

In this example, each subset of cyclones is arranged to receive air from a respective one of the plurality of conduits for conveying air from the first cyclonic separating unit 40 to the second cyclonic separating unit 42. The plurality of conduits are thus divided into a first set of relatively short conduits 130 which each convey air from the annular chamber 76 located behind the shroud to the air inlets 86 of a respective one of the five subsets of cyclones 110, 112, 114, 116, 118 of the first set of cyclones 100, and a second set of relatively long conduits 132 which each convey air from the annular chamber 76 to the air inlets 86 of a respective one of the five subsets of cyclones 120, 122, 124, 126, 128 of the second set of cyclones 102. As shown in FIG. 5, each set of conduits 130, 132 is arranged about the longitudinal axis Y, with the conduits of the first set of conduits 130 being arranged alternately with the conduits of the second set of conduits 132. The upper end of each conduit of the first set of conduits 130 may be closed by part of a vortex finder plate 92 shared between the cyclones of a respective subset of cyclones 110, 112, 114, 116, 118 of the first set of cyclones 100. Similarly, the upper end of each conduit of the second set of conduits 132 may be closed by part of a vortex finder plate 92 shared between the cyclones of a respective subset of cyclones 120, 122, 124, 126, 128 of the second set of cyclones 102.

Returning to FIGS. 4(*a*) to 4(*c*), each vortex finder 90 leads into a respective vortex finger 134 which communicates with a plenum or manifold 136 located at the top of the separating apparatus 26, and which is closed at the upper end thereof by a cover plate 138 of the separating apparatus 26. The cover plate 138 may also define part of the vortex fingers 134 for conveying air from the second set of cyclones 102 to the manifold 136. The manifold 136 communicates with an outlet duct 140 from which air is exhausted from the separating apparatus 26. The outlet duct 140 is arranged longitudinally down the centre of the separating apparatus 26, and is delimited by a third cylindrical wall 142 which depends from the second cyclonic separating unit 42. The third cylindrical wall 142 is located radially inwardly of the second cylindrical wall 58 and is spaced from the second cylindrical wall 58 so as to form a third annular chamber 144 therebetween. When the base 30 is in the closed position, the third cylindrical wall 142 may reach down to and be sealed against the base 30.

The third annular chamber 144 is surrounded by the first annular chamber 64, and is arranged so that the cone openings 88 of the cyclones 80 of the second cyclonic separating unit 42 protrude into the third annular chamber 144. Consequently, in use dust separated by the cyclones 80 of the second cyclonic separating unit 42 will exit through the cone openings 88 and will be collected in the third annular chamber 144. The third annular chamber 144 thus forms a dust collecting bin of the second cyclonic separating unit 42, and which can be emptied simultaneously with the dust collecting bin 64 of the first cyclonic separating unit 40.

During use of the vacuum cleaner 10, dust laden air enters the separating apparatus 26 via the dirty air inlet 66. Due to the tangential arrangement of the dirty air inlet 66, the dust laden air follows a helical path around the outer wall 52. Larger dirt and dust particles are deposited by cyclonic action in the first annular chamber 60 and collected in the dust collecting bin 64. The partially-cleaned dust laden air exits the first annular chamber 60 via the perforations 74 in the shroud and enters the second annular chamber 76. The partially-cleaned air then passes into the conduits 130, 132 and is conveyed to the air inlets 86 of the cyclones 80. Cyclonic separation is set up inside the cyclones 80 so that separation of dust particles which are still entrained within the airflow occurs. The dust particles which are separated from the airflow in the cyclones 80 are deposited in the third annular chamber 144. The further cleaned air then exits the cyclones 80 via the vortex finders 90 and passes into the manifold 136, from which the air enters the outlet duct 140. The further cleaned air then exhausts the separating apparatus 26 via an exit port 146 located in the base 30 of the separating unit 26.

The separating apparatus 26 thus includes two distinct stages of cyclonic separation. The first cyclonic separating unit 20 comprises a single cylindrical cyclone 62. The relatively large diameter of the outer wall 52 means that mainly comparatively large particles of dirt and debris will be separated from the air because the centrifugal forces applied to the dirt and debris are relatively small. A large proportion of the larger debris will reliably be deposited in the dust collecting bin 64.

The second cyclonic separating unit comprise twenty cyclones 80, each of which has a smaller diameter than the cylindrical cyclone 62 and so is capable of separating finer dirt and dust particles than the cylindrical cyclone 62. They also have the added advantage of being challenged with air which has already been cleaned by the cylindrical cyclone 62 and so the quantity and average size of entrained dust particles is smaller than would otherwise have been the case. The separation efficiency of the cyclones 80 is considerably higher than that of the cylindrical cyclone 62.

If desired, a filter (not shown) may also be provided downstream from the second cyclonic separating unit 42 to remove finer dust particles remaining in the air emitted therefrom. This filter may be located in the separating apparatus 26, for example within one of the manifold 136 and the outlet duct 140, or it may be located in the second ducting arrangement for conveying air from the separating apparatus 26 to the motor and fan unit.

Figure 7:
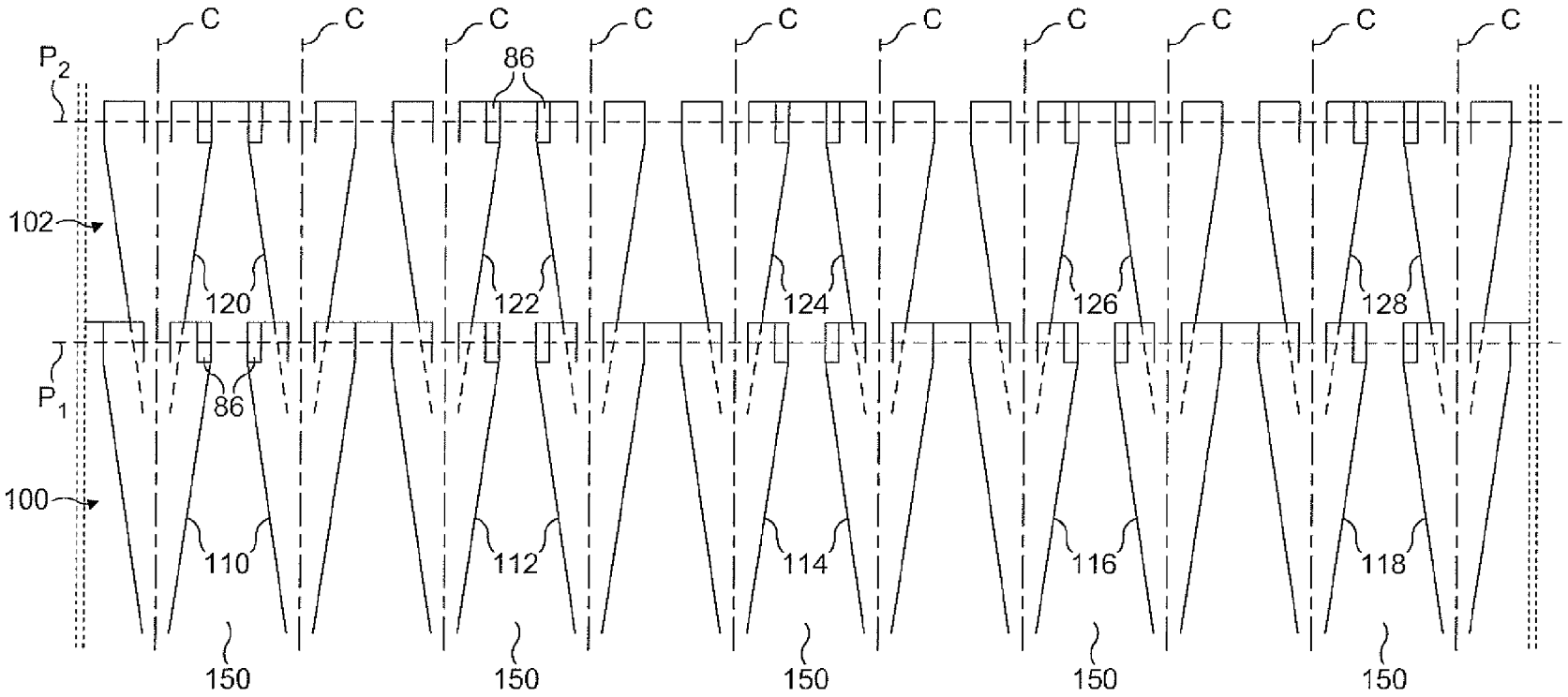
FIG. 7 is a schematic illustration of a first alternative arrangement of the cyclones of the second cyclonic separating unit about the central axis of the separating apparatus.

A first alternative arrangement of the cyclones 80 of the second cyclonic separating unit 42 is illustrated in FIG. 7, in which each of the conduits 150 for conveying air from the first cyclonic separating unit 40 to the second cyclonic separating unit 42 is arranged to convey air convey fluid to a subset of cyclones of the first set of cyclones 100, and to a subset of cyclones of the second set of cyclones 102. This can reduce the number of conduits from ten to five.

Figure 8:
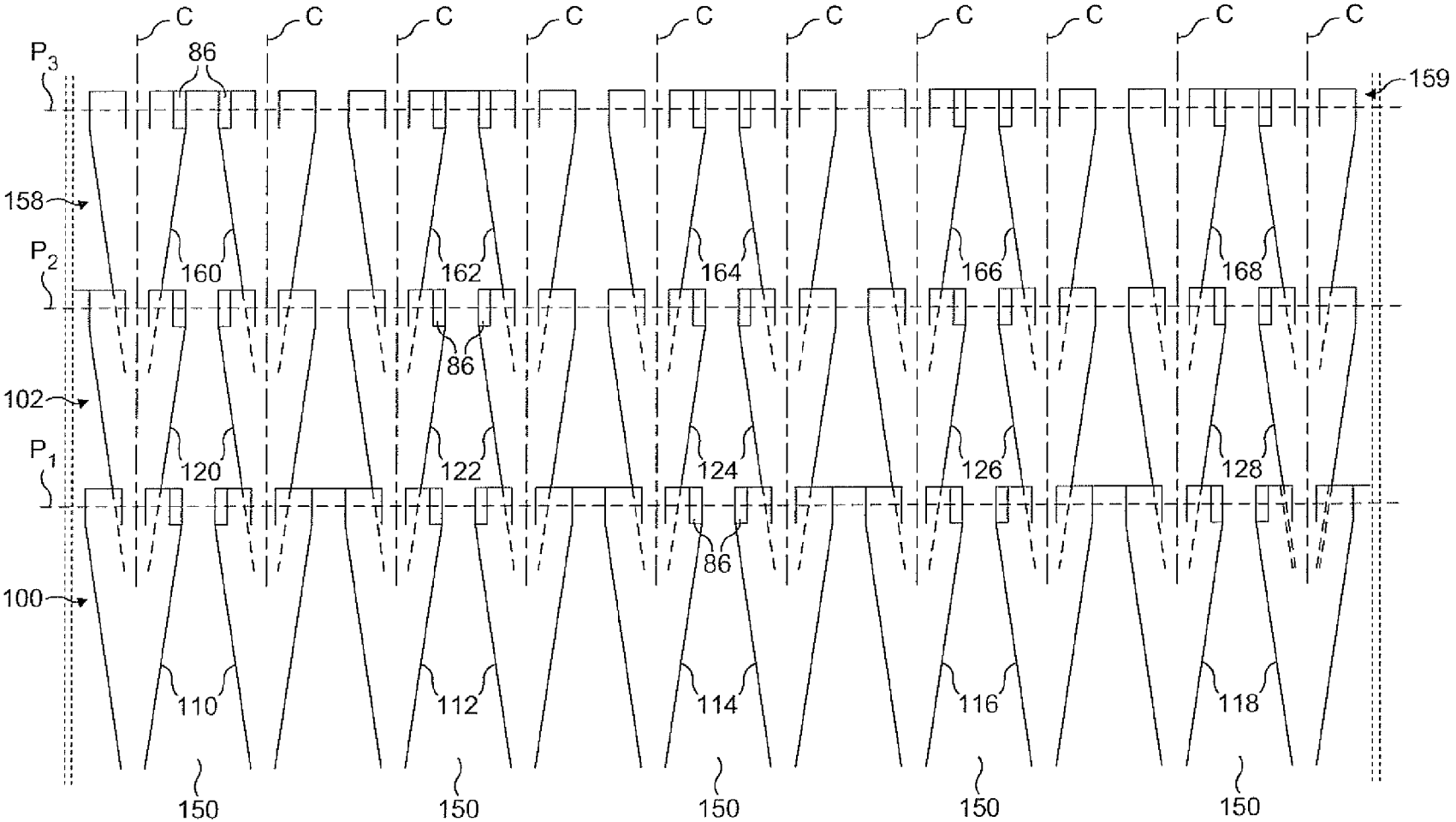
FIG. 8 is a schematic illustration of a second alternative arrangement of the cyclones of the second cyclonic separating unit about the central axis of the separating apparatus.

This arrangement of cyclones 80 can be readily divided into three or more sets of cyclones. For example, as illustrated in FIG. 8 a-third set of cyclones 158 may be located above the second set of cyclones 102. The air inlets 86 of the third set of cyclones 180 are arranged in a third group 159 which is spaced along the longitudinal axis Y from the second group 106. The third group 159 of air inlets 86 is located in a plane $P_3$ which is substantially orthogonal to the longitudinal axis Y. Again, to minimise the increase in the height of the separating apparatus 26 the second set of cyclones 102 extends about a lower part of the third set of cyclones 158. The third set of cyclones 158 is also divided into five subsets of cyclones 160, 162, 164, 166, 168, with each of the conduits 150 being arranged to convey air to a respective subset of each of the first, second and third sets of cyclones.

Figure 9:
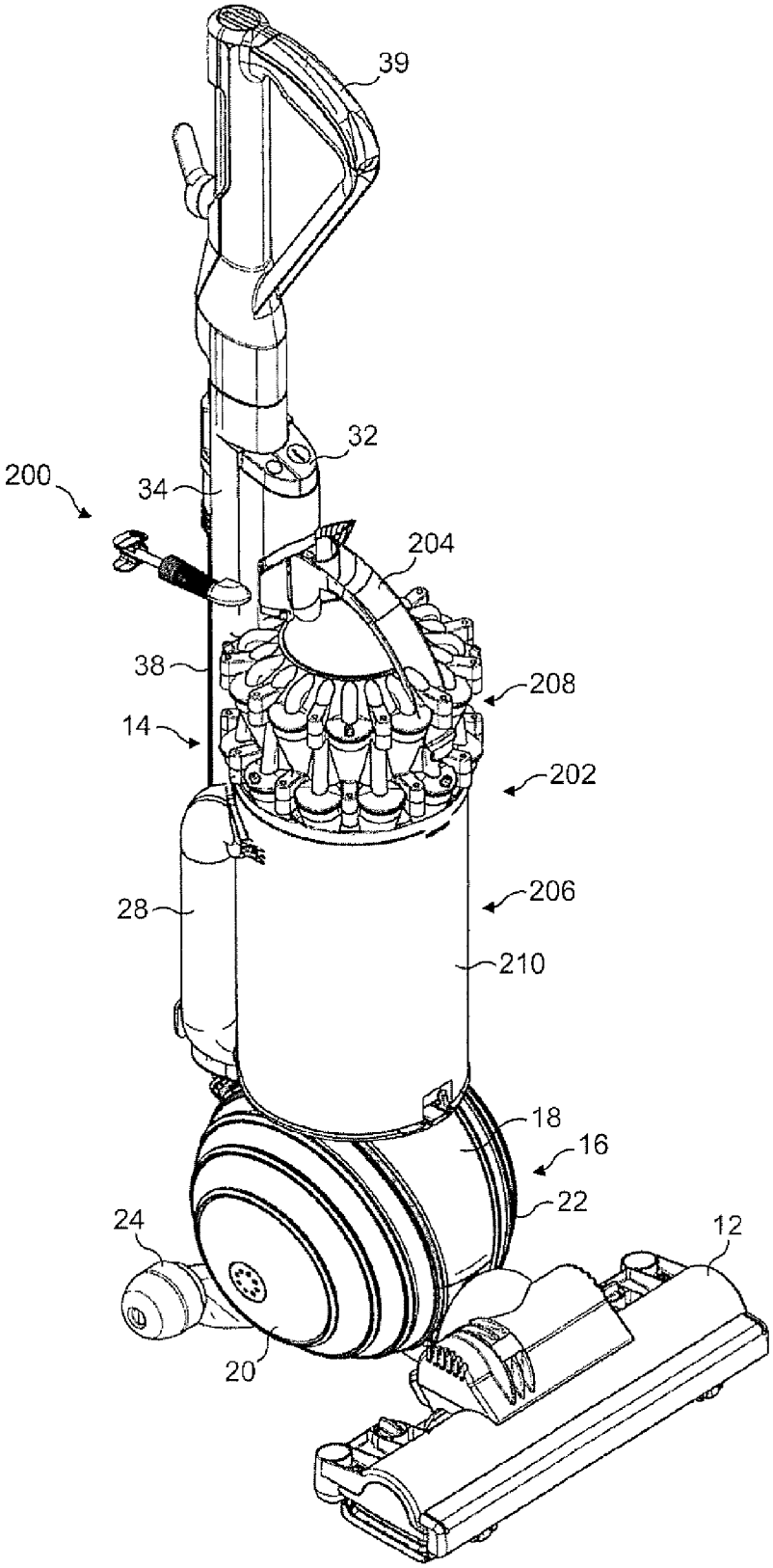
FIG. 9 is a front perspective view, from above, of a second example of a vacuum cleaner.
Figure 10:
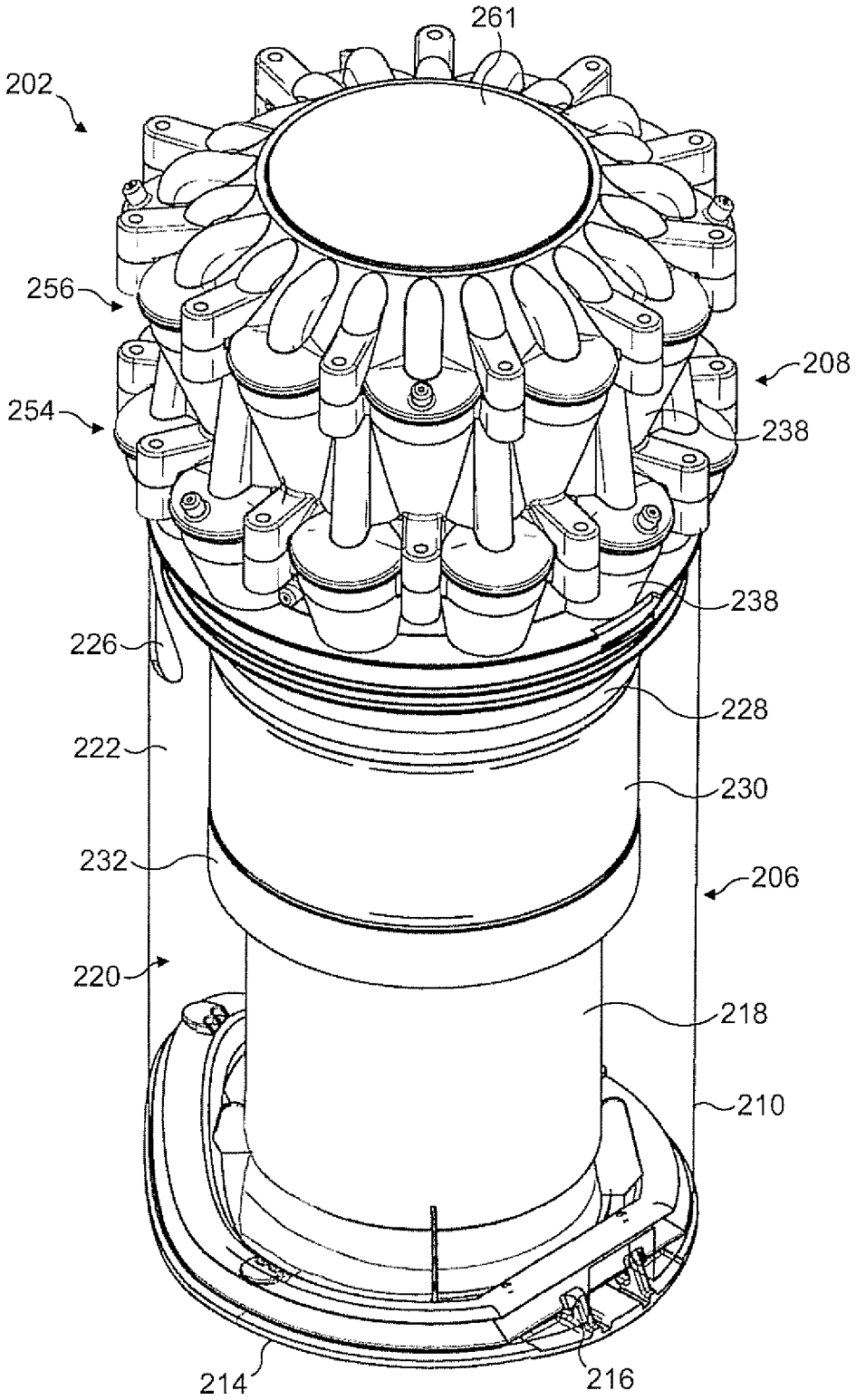
FIG. 10 is a front perspective view, from above, of a separating apparatus of the vacuum cleaner of FIG. 9.
Figure 11:
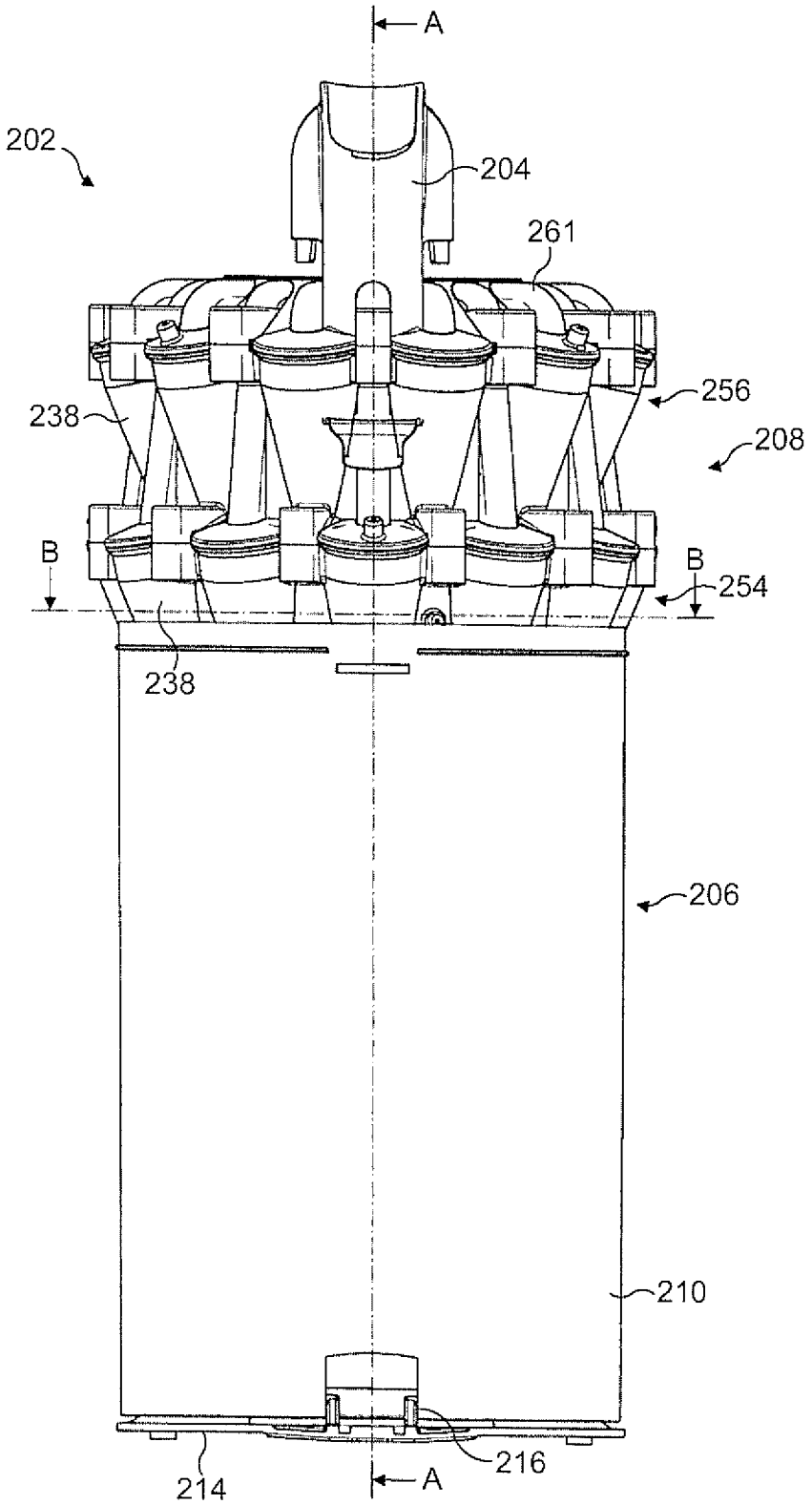
FIG. 11 is a front view of the separating apparatus of FIG. 10.

FIG. 9 illustrates a second example of a surface treating appliance, which is in the form of an upright vacuum cleaner. Similar to the vacuum cleaner 10 of FIG. 1, the vacuum cleaner 200 comprises a cleaner head 12, a main body 14 and a support assembly 16 for allowing the vacuum cleaner 10 to be rolled along a floor surface. These components of the vacuum cleaner 200 are generally the same as the corresponding components of the vacuum cleaner 10 of FIG. 1, and so the same reference numerals are used to indicate components of the main body 14 and the support assembly 16.

As with the vacuum cleaner 10, the main body 14 of the vacuum cleaner 200 includes separating apparatus 202 for removing dirt, dust and/or other debris from a dirt-bearing airflow which is drawn into the vacuum cleaner 200. A first ducting arrangement 28 provides communication between the dirty air inlet of the cleaner head 12 and the separating apparatus 202, whereas a second ducting arrangement (not shown) protruding from the top of the support assembly 16 provides communication between the separating apparatus 202 and the motor and fan unit located within the support assembly 16. The separating apparatus 202 may include a handle 204 to facilitate the removal of the separating apparatus 202 from the main body 14.

Similar to the separating apparatus 26, the separating apparatus 202 comprises a first cyclonic separating unit 206 and a second cyclonic separating unit 208 located downstream from the first cyclonic separating unit 206. The second cyclonic separating unit 208 is disposed above the first cyclonic separating unit 206, and in this example the first cyclonic separating unit 206 extends about part of the second cyclonic separating unit 208.

The separating apparatus 202 is shown in more detail in FIGS. 10 to 15; the handle 204 has been omitted from some of these figures. The separating apparatus 202 comprises an outer bin 210 which has an outer wall 212 which is substantially cylindrical in shape, and which extends about a longitudinal axis Y. The lower end of the outer bin 212 is closed by a base 214 of the separating apparatus 202. The base 214 is pivotably attached to the outer wall 212 by means of a pivot 216 and held in a closed position by a catch. The separating apparatus 202 further comprises a second cylindrical wall 218 which is co-axial with the outer wall 212. The second cylindrical wall 218 is located radially inwardly of the outer wall 212 and spaced therefrom so as to form an annular chamber 220 therebetween. In this example the upper portion of the annular chamber 220 forms a cylindrical cyclone 222 of the first cyclonic separating unit 206 and the lower portion of the annular chamber 220 forms a dust collecting bin 224 of the first cyclonic separating unit 206.

A dirty air inlet 226 is provided at the upper end of the outer bin 210 for receiving an air flow from the first ducting arrangement 28. The dirty air inlet 226 is arranged tangentially to the outer bin 210 so as to ensure that incoming dirty air is forced to follow a helical path around the annular chamber 220.

A fluid outlet is provided in the outer bin 210 in the form of a shroud. The shroud has an upper wall 228 formed in a frusto-conical shape, a lower cylindrical wall 230 and a skirt 232 depending from the cylindrical wall 230. In this example the skirt 232 is generally cylindrical. A large number of perforations (not shown) are formed in the lower cylindrical wall 230 of the shroud, and which provide the only fluid outlet from the outer bin 210.

Figure 12:
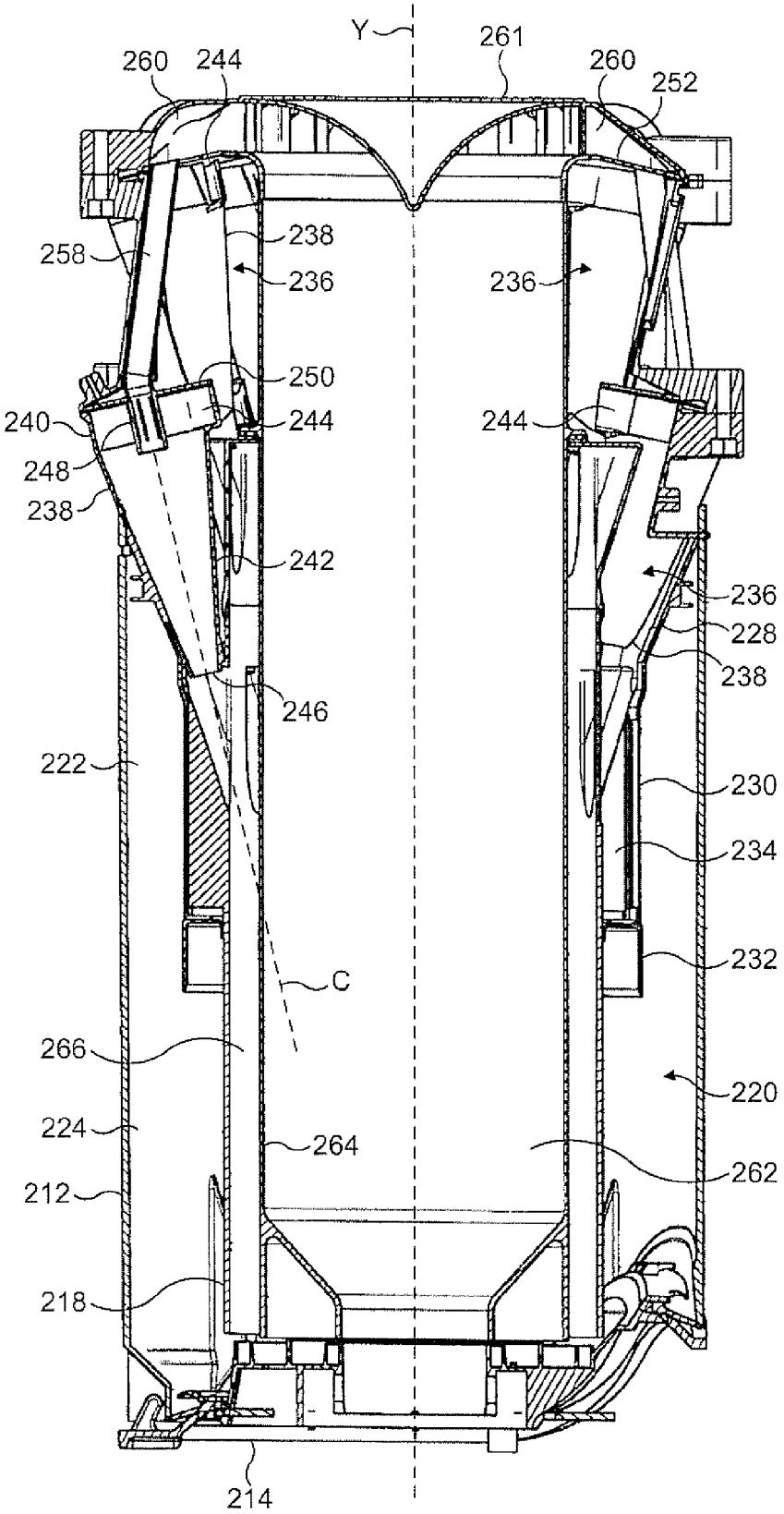
FIG. 12 is a side sectional view taken along line A-A in FIG. 11.
Figure 13:
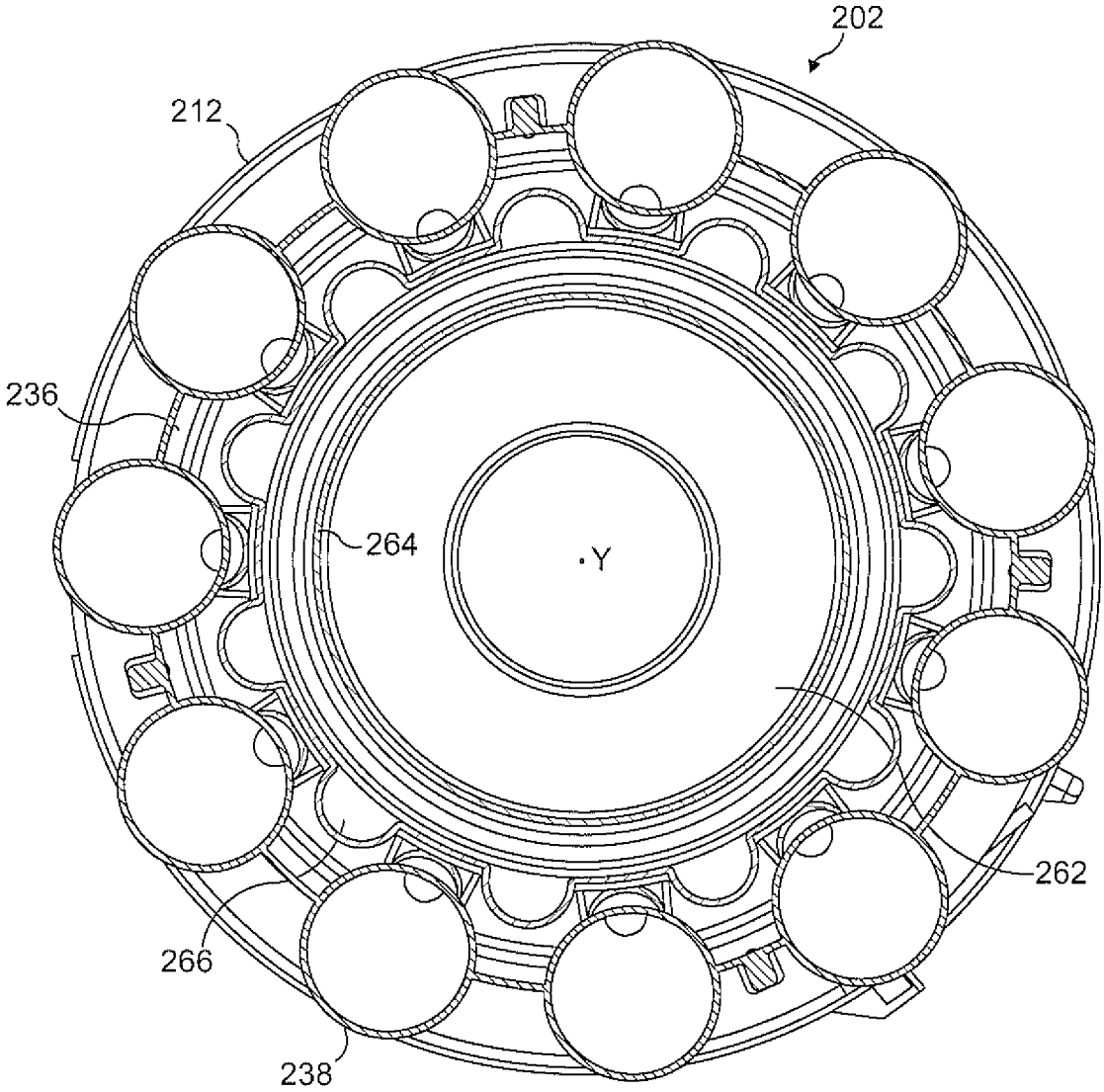
FIG. 13 is a top sectional view taken along line B-B in FIG. 11.
Figure 14:
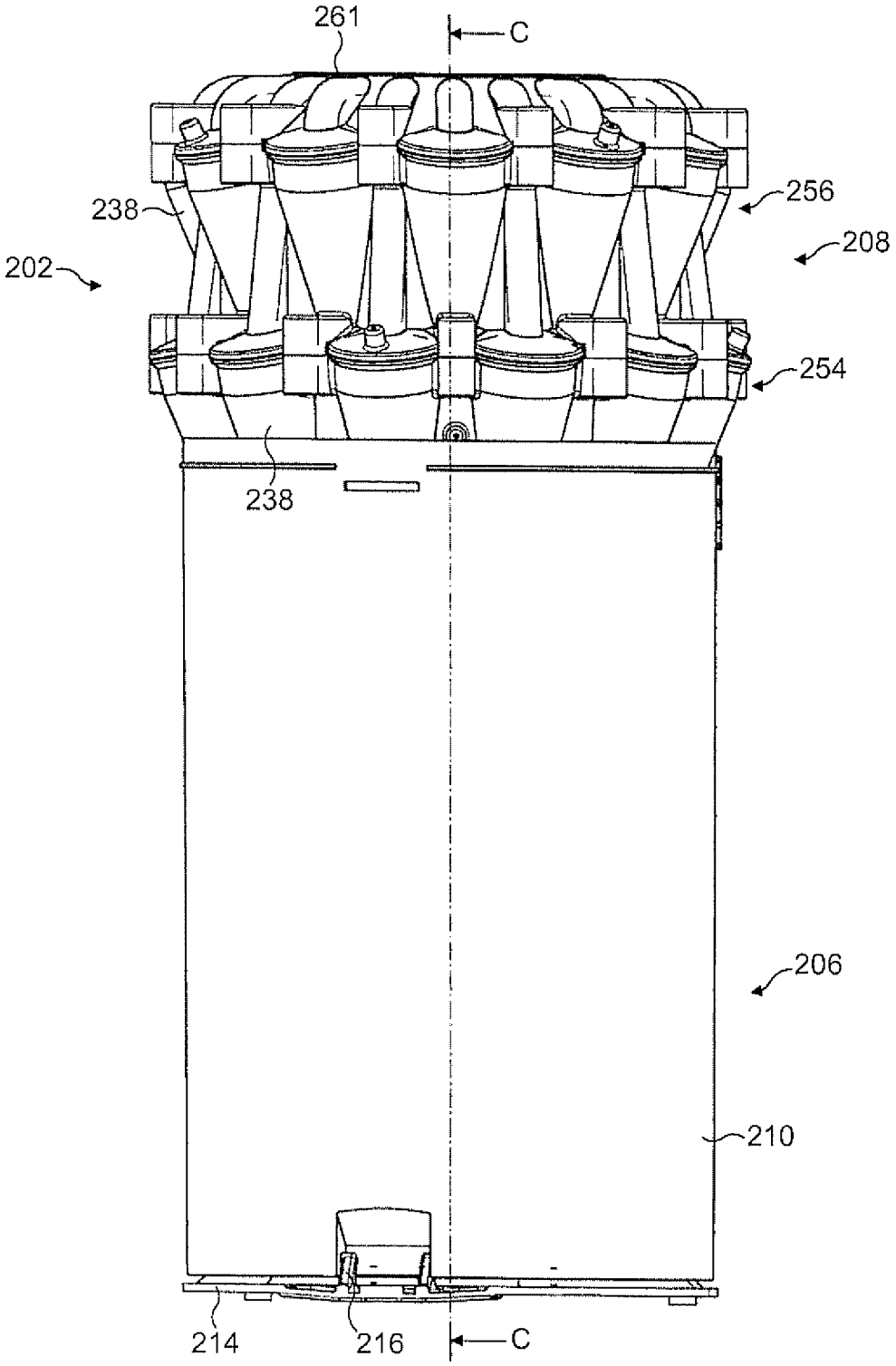
FIG. 14 is a front perspective view of the separating apparatus of FIG. 10.
Figure 15:
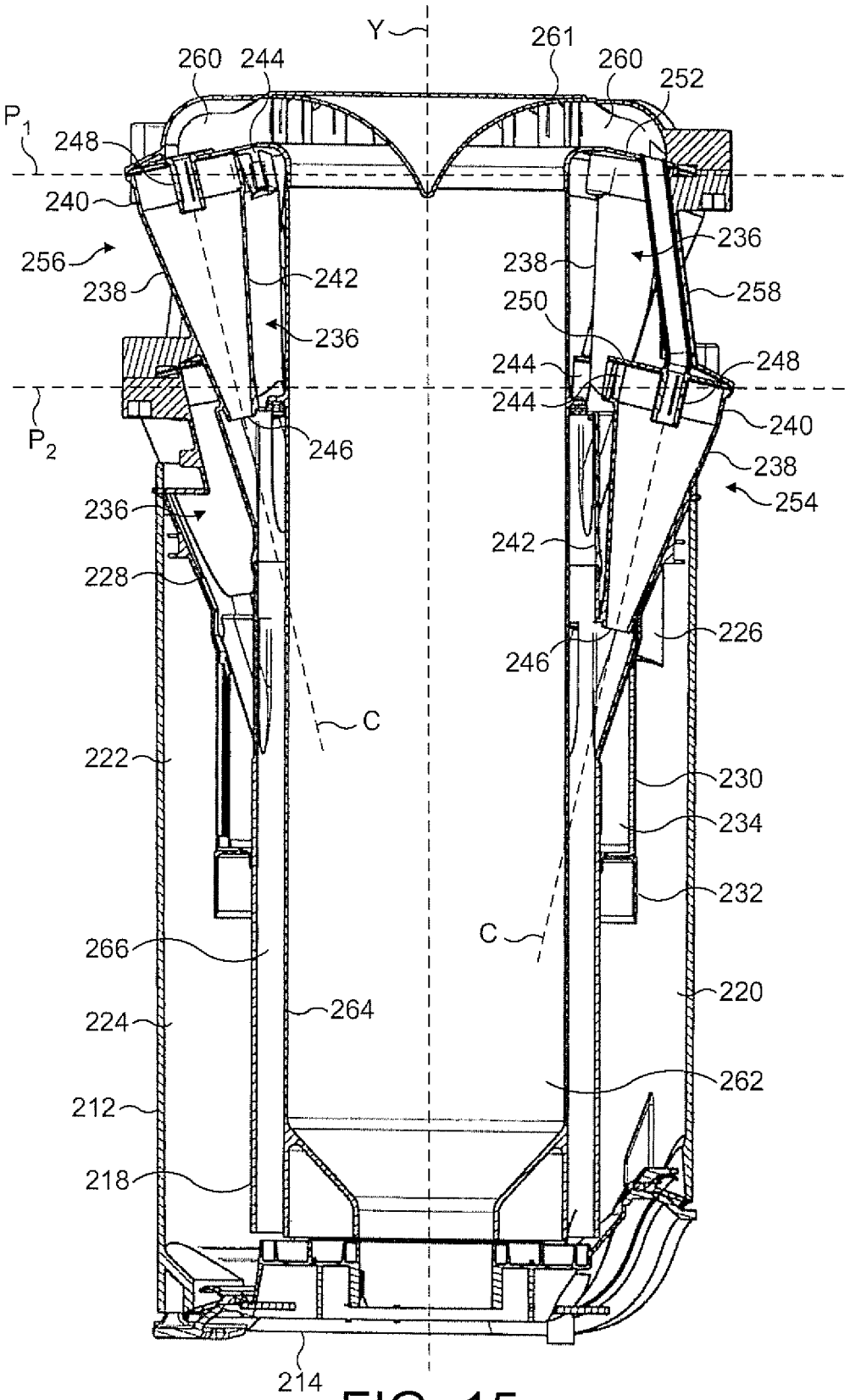
FIG. 15 is a side sectional view taken along line C-C in FIG. 14.

A second annular chamber 234 is located behind the shroud. In this example, a manifold 236 communicates with the chamber 234 for conveying air from the first cyclonic separating unit 206 to the second cyclonic separating unit 208. The second cyclonic separating unit 208 comprises a plurality of cyclones 238 arranged in parallel to receive air from the first cyclonic separating unit 206. With reference to FIGS. 12 and 15, in this example the cyclones 238 are substantially identical. Each cyclone 238 comprises a cylindrical portion 240 and a tapering portion 242 depending therefrom. The cylindrical portion 240 comprises an air inlet 244 for receiving fluid from the manifold 236. The tapering portion 242 of each cyclone 238 is frusto-conical in shape and terminates in a cone opening 246. A vortex finder 248 is provided at the upper end of each cyclone 238 to allow air to exit the cyclone 238. Each vortex finder 90 extends downwardly from a vortex finder plate 250, 252 which is disposed over the cylindrical portion 240.

As with the separating apparatus 26, the cyclones 238 of the second cyclonic separating unit 208 are divided into a first set of cyclones 254 and a second set of cyclones 256. Each set of cyclones 254, 256 preferably comprises the same number of cyclones 238, and in this example each set of cyclones 254, 256 comprises eleven cyclones 238. Each set of cyclones 254, 256 is arranged in a ring which is centered on a longitudinal axis Y of the outer wall 212, and thus of the first cyclonic separating unit 206. Within each set of cyclones 254, 256 each cyclone 238 has a longitudinal axis C which is inclined downwardly and towards the longitudinal axis Y of the outer wall 212. As with the separating apparatus 26, the longitudinal axes C are inclined at the same angle to the longitudinal axis Y of the outer wall 212. Within each set of cyclones 254, 256, the cyclones 238 are substantially equidistant from the longitudinal axis Y, and are substantially equidistantly spaced about the longitudinal axis Y.

Again, to reduce the external diameter of the separating apparatus 202 the arrangement of the sets of cyclones 254, 256 is such that the air inlets 244 of the first set of cyclones 254 are arranged in a first group, and the air inlets 244 of the second set of cyclones 256 are arranged in a second group which is spaced along the longitudinal axis Y from the first group. Similar to the separating apparatus 202, and as illustrated in FIG. 15, each group of air inlets 244 is located within a respective plane $P_1$, $P_2$, with each of these planes $P_1$, $P_2$ being substantially orthogonal to the longitudinal axis Y. The planes $P_1$, $P_2$ are located along the longitudinal axis Y so that the second set of cyclones 256 is located above the first set of cyclones 254.

Again, to minimise the increase in the height of the separating apparatus 202, the first cyclonic separating unit 206 extends about a lower part of the first set of cyclones 254 and the first set of cyclones 254 extends about a lower part of the second set of cyclones 256. However, unlike the separating apparatus 26 the cyclones 238 of the second set of cyclones 256 are angularly offset about the longitudinal axis Y relative to the cyclones 238 of the first set of cyclones 254. In this example, each cyclone 238 of the second set of cyclones 256 is located angularly midway between, and spaced along the longitudinal axis Y, an adjacent pair of cyclones 238 of the first set of cyclones 256 so as to accommodate some of the space located between the pair of cyclones 238. This can allow the first and second sets of cyclones 254, 256 to be brought closer together, further reducing the overall height of the separating apparatus 202.

As mentioned above, each of the cyclones 238 of the second cyclonic separating unit 208 is arranged to receive fluid from a manifold 236. The manifold 236 may thus be considered to have a fluid inlet adjacent the lower cylindrical wall 230 of the shroud, and a plurality of fluid outlets each for conveying fluid to a fluid inlet 244 of a respective cyclone 238 of the second cyclonic separating unit 208.

Each vortex finder 248 of the cyclones 238 of the first set of cyclones 254 leads into a respective vortex finger 258 which communicates with an outlet chamber 260 located at the top of the separating apparatus 202. The vortex fingers 258 pass through apertures formed in the vortex finder plate 252. Each vortex finder 248 of the cyclones 238 of the second set of cyclones 256 exhausts fluid directly into the outlet chamber 260. The outlet chamber 260 is closed at the upper end thereof by a cover plate 261 of the separating apparatus 202. The outlet chamber 260 communicates with an outlet duct 262 from which air is exhausted from the separating apparatus 202. Again, the outlet duct 262 is arranged longitudinally down the centre of the separating apparatus 202, and is delimited by a third cylindrical wall 264 which depends from the vortex finder plate 252. The third cylindrical wall 264 is located radially inwardly of the second cylindrical wall 218 and is spaced from the second cylindrical wall 218 so as to form a third annular chamber 266 therebetween.

The third annular chamber 266 is surrounded by the first annular chamber 224, and is arranged so that the cone openings 246 of the cyclones 238 of the second cyclonic separating unit 208 protrude into the third annular chamber 266. Consequently, in use dust separated by the cyclones 238 of the second cyclonic separating unit 208 will exit through the cone openings 246 and will be collected in the third annular chamber 266. The third annular chamber 266 thus forms a dust collecting bin of the second cyclonic separating unit 208.

Again, if desired, a filter (not shown) may also be provided downstream from the second cyclonic separating unit 208 to remove finer dust particles remaining in the air emitted therefrom. This filter may be located within one of the outlet chamber 260 and the outlet duct 262.

Figure 16:
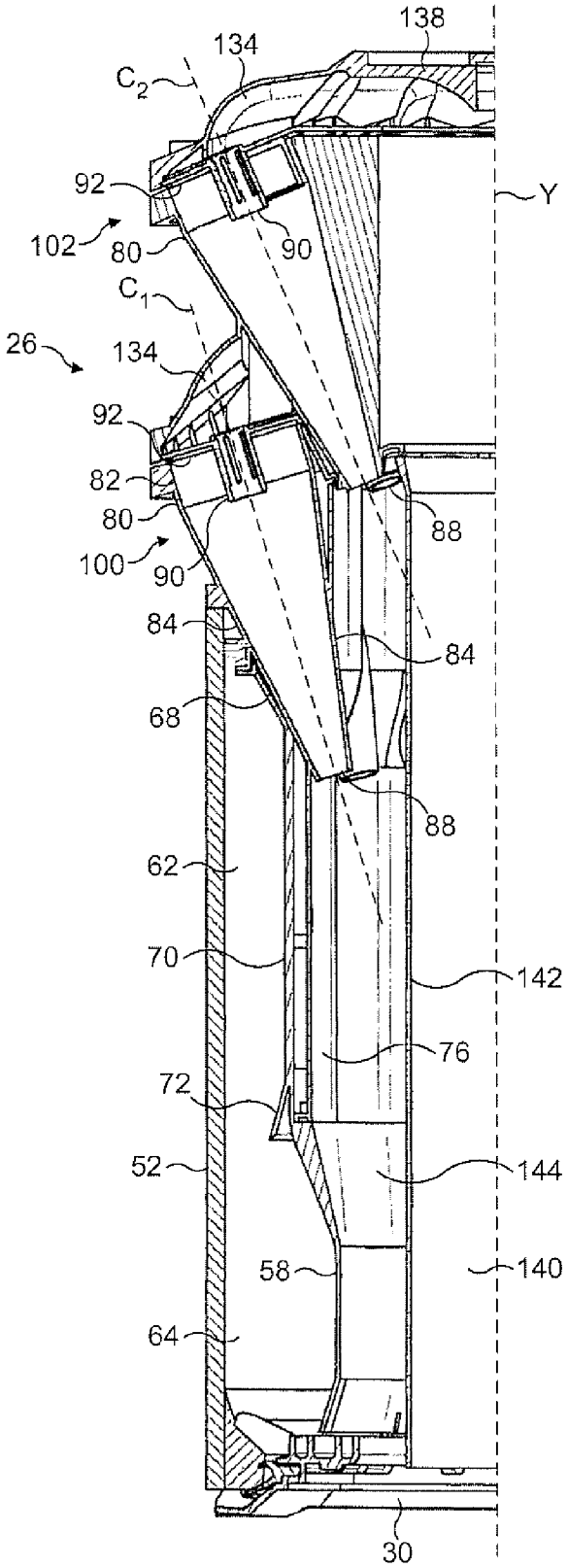
FIG. 16 is a side sectional view of part of an alternative separating apparatus for use with the vacuum cleaner of FIG. 9.

In each separating apparatus 26, 202 discussed above, the longitudinal axes C of the cyclones 80, 238 are arranged at the same angle to the longitudinal axis Y of the first cyclonic separating unit 40, 204. However, the cyclones may be arranged so that the longitudinal axes of the cyclones of one of the sets of cyclones are inclined at a different angle to the cyclones of the other set of cyclones. Increasing the angle at which one of the sets of cyclones is inclined to the longitudinal axis of the first cyclonic separating unit can decrease the overall height of the separating apparatus. For example, FIG. 16 illustrates a variation of the arrangement of the cyclones of the separating apparatus 26. FIG. 16 is an equivalent view to FIG. 4(*b*), and illustrates the longitudinal axes $C_2$ of the cyclones 80 of the second set of cyclones 102 inclined at a greater angle to the longitudinal axis Y of the first cyclonic separating unit 40 than the longitudinal axes $C_1$ of the cyclones 80 of the first set of cyclones 100.

The invention claimed is:

1. A surface treating appliance comprising a first cyclonic separating unit having a longitudinal axis and, downstream from the first cyclonic separating unit, a second cyclonic separating unit comprising a plurality of cyclones arranged about the axis and a dust collector arranged to receive dust from each of the plurality of cyclones, each cyclone comprising a fluid inlet and a fluid outlet, the plurality of cyclones being divided into at least a first set of cyclones and a second set of cyclones, the first set of cyclones and the second set of cyclones being fed in parallel and coaxially arranged about the axis, the fluid inlets of the first set of cyclones being arranged in a first group and the fluid inlets of the second set of cyclones being arranged in a second group longitudinally spaced along the axis from the first group.

2. The appliance of claim 1, wherein the first group of fluid inlets is generally arranged in a first annular arrangement, and the second group of fluid inlets is generally arranged in a second annular arrangement spaced along said axis from the first annular arrangement.

3. The appliance of claim 2, wherein each of the annular arrangements is substantially orthogonal to said axis.

4. The appliance of claim 2, wherein the annular arrangements are of substantially the same size.

5. The appliance of claim 1, wherein, within each set, the fluid inlets are substantially co-planar.

6. The appliance of claim 1, wherein, within each set, the cyclones are substantially equidistant from said axis.

7. The appliance of claim 1, wherein, within each set, the cyclones are substantially equidistantly spaced about said axis.

8. The appliance of claim 1, wherein the first cyclonic separating unit at least partially surrounds the dust collector.

9. The appliance of claim 1, wherein the second cyclonic separating unit is substantially co-axial with the first cyclonic separating unit.

10. The appliance of claim 1, wherein each cyclone has a longitudinal axis, and wherein the longitudinal axes of the cyclones of the first set of cyclones approach one another and the longitudinal axes of the cyclones of the second set of cyclones approach one another.

11. The appliance of claim 10, wherein the longitudinal axes of the cyclones intersect the longitudinal axis of the first cyclonic separating unit.

12. The appliance of claim 11, wherein the angle at which the longitudinal axes of the first set of the cyclones intersect the longitudinal axis of the first cyclonic separating unit is substantially the same as the angle at which the longitudinal axes of the second set of the cyclones intersect the longitudinal axis of the first cyclonic separating unit.

13. The appliance of claim 1, wherein the first set of cyclones extends about part of the second set of cyclones.

14. The appliance of claim 1, comprising a plurality of conduits for conveying fluid from the first cyclonic separating unit to the second cyclonic separating unit, the appliance having a shroud forming an outlet from the first cyclonic separating unit, the shroud comprising a wall having a multiplicity of through-holes, and wherein each conduit comprises an inlet located behind the wall of the shroud.

15. The appliance of claim 1, comprising a manifold for conveying fluid from the first cyclonic separating unit to the second cyclonic separating unit.

16. The appliance of 1, wherein each cyclone of the second set of cyclones is located immediately above a respective cyclone of the first set of cyclones.

17. The appliance of 1, wherein the second set of cyclones is angularly offset about the longitudinal axis of the first cyclonic separating unit relative to the first set of cyclones.

18. The appliance of claim 17, wherein each cyclone of the second set of cyclones is located angularly between, and spaced along the axis from, an adjacent pair of cyclones of the first set of cyclones.

19. The appliance of claim 1, wherein the first cyclonic separating unit and the second cyclonic separating unit form part of a separating apparatus removably mounted on a main body of the appliance.

20. The appliance of claim 1, comprising a vacuum cleaning appliance.

21. A surface treating appliance comprising a first cyclonic separating unit and, downstream from the first cyclonic separating unit, a second cyclonic separating unit comprising a plurality of cyclones arranged about an axis and a dust collector arranged to receive dust from each of the plurality of cyclones, each cyclone comprising a fluid inlet and a fluid outlet, the plurality of cyclones being divided into at least a first set of cyclones arranged in an annular arrangement and a second set of cyclones arranged in an annular arrangement above the first set of cyclones, the first set of cyclones and the second set of cyclones being fed in parallel, the fluid inlets of the first set of cyclones being spaced along the axis from the fluid inlets of the second set of cyclones.

22. A surface treating appliance comprising a first cyclonic separating unit and a second cyclonic separating unit located above the first cyclonic separating unit, wherein the second cyclonic separating unit is downstream from the first cyclonic separating unit and comprises a plurality of cyclones and a dust collector arranged to receive dust from each of the plurality of cyclones, each cyclone comprising a fluid inlet and a fluid outlet, the plurality of cyclones being divided into at least a first set of cyclones and a second set of cyclones, the first set of cyclones and the second set of cyclones being fed in parallel, and the second set of cyclones being located above the first set of cyclones.

* * * * *